United States Patent [19]

Miller, Jr.

[11] 4,171,994

[45] Oct. 23, 1979

[54] USE OF NITROGEN-BEARING BASE COATINGS IN THE MANUFACTURE OF HIGH PERMEABILITY SILICON STEEL

[75] Inventor: Clarence L. Miller, Jr., Pittsburgh, Pa.

[73] Assignee: Allegheny Ludlum Industries, Inc., Pittsburgh, Pa.

[21] Appl. No.: 743,876

[22] Filed: Nov. 22, 1976

Related U.S. Application Data

[63] Continuation-in-part of Ser. No. 549,565, Feb. 13, 1975, abandoned.

[51] Int. Cl.[2] ..... H01F 1/04

[52] U.S. Cl. ..... 148/111; 148/27; 148/31.55; 148/113

[58] Field of Search ..... 148/113, 112, 111, 31.55, 148/27; 204/37; 427/127

[56] References Cited

U.S. PATENT DOCUMENTS

| | | | |
|---|---|---|---|
| 3,054,732 | 9/1962 | McQuade | 204/37 |
| 3,615,919 | 10/1971 | Pavlik et al. | 148/113 |
| 3,671,337 | 6/1972 | Kumki et al. | 148/111 |
| 3,676,227 | 7/1972 | Matsumoto et al. | 148/111 |
| 3,697,322 | 10/1972 | Lee et al. | 427/127 |
| 3,700,506 | 10/1972 | Tanaka et al. | 148/111 |
| 3,855,018 | 12/1974 | Salsgiver et al. | 148/112 |
| 3,941,623 | 3/1976 | Takashina et al. | 148/113 |
| 3,957,546 | 5/1976 | Fiedler | 148/111 |
| 3,959,034 | 5/1976 | Akerblom | 148/113 |
| 4,010,050 | 3/1977 | Choby | 148/113 |

FOREIGN PATENT DOCUMENTS

| | | | |
|---|---|---|---|
| 49-6455 | 2/1974 | Japan | 148/112 |

*Primary Examiner*—L. Dewayne Rutledge
*Assistant Examiner*—John P. Sheehan
*Attorney, Agent, or Firm*—Vincent G. Gioia; Robert F. Dropkin

[57] ABSTRACT

A process for producing silicon steel having a cube-on-edge orientation and a permeability of at least 1850 ($G/O_e$) at 10 oersteds, which includes the steps of: preparing a melt of steel consisting essentially of, by weight, up to 0.07% carbon, from 2.6 to 4.0% silicon, from 0.03 to 0.24% manganese, from 0.01 to 0.09% of material from the group consisting of sulfur and selenium, at least one element from the group consisting of aluminum in an amount of from 0.015 to 0.04% and boron in an amount of up to 0.0035%, up to 0.02% nitrogen, up to 0.5% copper, balance iron; casting the steel, hot rolling the steel, cold rolling the steel, decarburizing the steel, coating the steel with a base coating containing a nitrogen-bearing compound from the group consisting of $(NH_4)_2SO_4$, $Fe(NO_3)_3$, $Al(NO_3)_3$, $Mg(NO_3)_2$ and $Zn(NO_3)_2$, and final texture annealing the steel.

15 Claims, No Drawings

USE OF NITROGEN-BEARING BASE COATINGS IN THE MANUFACTURE OF HIGH PERMEABILITY SILICON STEEL

This application is a continuation-in-part of now abandoned copending application Ser. No. 549,565, filed Feb. 13, 1975.

The present invention relates to a process utilizing a base coating containing a nitrogen-bearing compound from the group consisting of $(NH_4)_2SO_4$, $Fe(NO_3)_3$, $Al(NO_3)_3$, $Mg(NO_3)_2$ and $Zn(NO_3)_2$, in the manufacture of electromagnetic silicon steel having a cube-on-edge orientation and a permeability of at least 1850 ($G/O_e$) at 10 oersteds.

The use of nitrogen in final annealing atmospheres has in many instances improved texture development for the new breed of high permeability silicon steels, such as those disclosed in U.S. Pat. No. 3,855,020, which issued on Dec. 17, 1974. Such use has not, however, been without problems. In annealing coils of the steel, difficulty in diffusion nitrogen through the laps of the coils has been encountered.

The present invention provides nitrogen in the annealing environment and simultaneously overcomes the heretofore referred to difficulties encountered with nitrogen-bearing annealing atmospheres. It calls for the use of a base coating containing a nitrogen-bearing compound from the group consisting of $(NH_4)_2SO_4$, $Fe(NO_3)_3$, $Al(NO_3)_3$, $Mg(NO_3)_2$ and $Zn(NO_3)_2$. The nitrogen in the coating has been found to serve the same purpose as does the nitrogen in the annealing atmosphere. In the manufacture of grain oriented silicon steels, base coatings are applied to the steel just prior to final texture annealing. Disclosures of nitrogen in a base coating appear in Japanese Pat. No. 6455/74 (published Feb. 14, 1974), U.S. Pat. Nos. 3,697,322 and 3,941,623, and United States Patent Application Ser. No. 611,060 (filed Sept. 8, 1975), now U.S. Pat. No. 4,010,050. Among other differences, none of these references disclose the use of a nitrogen-bearing compound from the group consisting of $(NH_4)_2SO_4$, $FE(NO_3)_3$, $Al(NO_3)_3$, $Mg(NO_3)_2$ and $Zn(NO_3)_2$.

It is accordingly an object of the present invention to provide a process utilizing a base coating containing a nitrogen-bearing compound from the group consisting of $(NH_4)_2SO_4$, $Fe(NO_3)_3$, $Al(NO_3)_3$, $Mg(NO_3)_2$ and $Zn(NO_3)_2$, in the manufacture of electromagnetic silicon steel having a cube-on-edge orientation and a permeability of at least 1850 ($G/O_e$) at 10 oersteds.

In accordance with the present invention, a melt of silicon steel is subjected to the conventional steps of casting, hot rolling, cold rolling (generally at a reduction of at least 80%), decarburizing and final texture annealing; and to the improvement of adding a nitrogen-bearing compound from the group consisting of $(NH_4)_2SO_4$, $Fe(NO_3)_3$, $Al(NO_3)_3$, $Mg(NO_3)_2$ and $Zn(NO_3)_2$ to the base coating. Specific processing is not critical and can be in accordance with that specified in any number of publications including U.S. Pat. Nos. 3,855,018, 3,855,019, 3,855,020 and 3,855,021. The melt consists essentially of, by weight up to 0.07% carbon, from 2.6 to 4.0% silicon, from 0.03 to 0.24% manganese, from 0.01 to 0.09% of material from the group consisting of sulfur and selenium, at least one element from the group consisting of aluminum in an amount of from 0.015 to 0.04% and boron in an amount of up to 0.0035%, up to 0.02% nitrogen, up to 0.5% copper, balance iron. When boron is present, levels thereof are generally at least 0.0006%, and preferably, at least 0.0008%. In boron bearing embodiments, aluminum is generally no more than 0.008%. The base coating consists essentially of:

(a) 100 parts, by weight, of at least one substance from the group consisting of boron, boron compounds, sulfur, sulfur compounds, selenium, selenium compounds, and oxides and hydroxides of magnesium, calcium, aluminum, titanium and manganese; and (b) 0.5 to 50 parts, by weight of at least one nitrogen-bearing compound from the group consisting of $(NH_4)_2SO_4$, $Fe(NO_3)_3$, $Al(NO_3)_3$, $Mg(NO_3)_2$ and $Zn(NO_3)_2$.

The nitrogen-bearing compounds are preferably present in an amount of from 1.5 to 5 parts, by weight. $(NH_4)_2SO_4$ is the preferred nitrogen-bearing compound. A base coating containing from 1.5 to 5 parts, by weight of $(NH_4)_2SO_4$ and 100 parts, by weight, of boron, boron compounds, and oxides and hydroxides of magnesium is presently preferred. Examples of this coating appear hereinbelow.

The following examples are illustrative of several aspects of the invention.

EXAMPLE I

Two heats of steel were cast and processed into silicon steel having a cube-on-edge orientation. The chemistry of the heats appears hereinbelow in Table I.

TABLE I

| | Composition (wt. %) | | | | | | |
|---|---|---|---|---|---|---|---|
| Heat | C | Mn | Si | S | Al | N | Fe |
| A | 0.05 | 0.11 | 2.92 | 0.03 | 0.023 | 0.0055 | Bal. |
| B | 0.053 | 0.13 | 2.85 | 0.031 | 0.023 | 0.0055 | Bal. |

Processing for the heats involved soaking at an elevated temperature for several hours, hot rolling to a gage of approximately 93 mils, normalizing, cold rolling to a final gage of approximately 12 mils, decarburizing at a temperature of 1475° F. in a mixture of wet hydrogen and nitrogen, applying one of four base coatings, and final texture annealing at a maximum temperature of 2150° F. The four base coatings are as follows:

I. 100 parts MgO

II. 100 parts MgO+2 parts $H_3BO_3$

III. 100 parts MgO+2 parts $H_3BO_3$+4 parts $(NH_4)_2SO_4$+4 parts $(NH_4)_2SO_4$ IV. 100 parts MgO The heats were tested for permeability and core loss. Results of the tests appear hereinbelow in Table II. Note that the results are arranged so as to reflect the base coating used.

TABLE II

| | Heat A | | Heat B | |
|---|---|---|---|---|
| Coating | Permeability (at 10 $O_e$) | Core Loss (WPP at 17KB) | Permeability (at 10 $O_e$) | Core Loss. (WPP at 17KB) |
| I. | 1863 | 0.787 | 1826 | 0.860 |
| II. | 1911 | 0.698 | 1885 | 0.752 |
| III. | 1943 | 0.657 | 1879 | 0.705 |
| IV. | 1933 | 0.679 | 1919 | 0.680 |

From the results appearing in Table II, it is clear that the inclusion of $(NH_4)_2SO_4$ in the base coating improved texture development. Steels coated with coatings IV and III had respectively higher permeabilities and lower core loses than did steels coated with coatings I and II. Coatings IV and III contained $(NH_4)_2SO_4$ whereas coatings I and II were devoid thereof.

EXAMPLE II

An additional heat of steel was cast and processed into silicon steel having a cube-on-edge orientation. The chemistry of the heat appears hereinbelow in Table III.

TABLE III

| | Composition (Wt. %) | | | | | | | |
|---|---|---|---|---|---|---|---|---|
| Heat | C | Mn | Si | S | Al | B | N | Fe |
| C | 0.031 | 0.032 | 3.18 | 0.030 | 0.004 | 0.0011 | 0.0048 | Bal. |

Processing for the heat involved soaking at an elevated temperature for several hours, hot rolling to a gage of approximately 80 mils, normalizing, cold rolling to a gage of approximately 60 mils, normalizing, cold rolling to a gage of approximately 11 mils, decarburizing at a temperature of 1475° F., applying base coating No. IV (see Example I), and final texture annealing at a maximum temperature of 2150° F.

Heat C was tested for permeability and core loss. The results of the tests appear hereinbelow in Table IV.

TABLE IV

| Heat | Permeability (at 10 $O_e$) | Core Loss (WPP at 17KB) |
|---|---|---|
| C | 1863 | 0.697 |

From Table IV, it is noted that Heat C had a permeability in excess of 1850 ($G/O_e$) at 10 oersteds and a core loss of less than 0.700 watts per pound at 17 kilogauss.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation and a permeability of at least 1850 ($G/O_e$) at 10 oersteds, which process includes the steps of: preparing a melt of silicon steel consisting essentially of, by weight, up to 0.07% carbon, from 2.6 to 4.0% silicon, from 0.03 to 0.24% manganese, from 0.01 to 0.09% of material selected from the group consisting of sulfur and selenium, from 0.015 to 0.04% aluminum, up to 0.0035% boron, up to 0.02% nitrogen, up to 0.5% copper, balance iron; casting said steel; hot rolling said steel into a hot rolled band; cold rolling said steel, decarburizing said steel; and final texture annealing said steel; the improvement comprising the steps of coating the surface of said steel with a base coating consisting essentially of:

(a) 100 parts, by weight, of at least one substance selected from the group consisting of boron, boron compounds, sulfur, sulfur compounds, selenium, selenium compounds, and oxides and hydroxides of magnesium, calcium, aluminum, titanium and manganese; and (b) 0.5 to 50 parts, by weight, of at least one nitrogen-bearing compound selected from the group consisting of $(NH_4)_2SO_4$, $Fe(NO_3)_3$, $Al(NO_3)_3$, $Mg(NO_3)_2$ and $Zn(NO_3)_2$;

and final texture annealing said steel; said steel's texture and magnetic properties being, in part, attributable to said nitrogen bearing compound.

2. The improvement according to claim 1, wherein said coating has from 1.5 to 5 parts, by weight, of at least one nitrogen-bearing compound.

3. The improvement according to claim 1, wherein said coating contains $(NH_4)_2SO_4$.

4. The improvement according to claim 1, wherein said coating consists essentially of: 100 parts, by weight, of boron, boron compounds, and oxides and hydroxides of magnesium; and 0.5 to 50 parts, by weight, of at least one nitrogen-bearing compound selected from the group consisting of $(NH_4)_2SO_4$, $Fe(NO_3)_3$, $Al(NO_3)_3$, $Mg(NO_3)_2$ and $Zn(NO_3)_2$.

5. The improvement according to claim 4, wherein said coating has from 1.5 to 5 parts, by weight, of at least one nitrogen-bearing compound.

6. The improvement according to claim 4, wherein said coating contains $(NH_4)_2SO_4$.

7. The process according to claim 1, wherein said steel is cold rolled at a reduction of at least 80%.

8. In a process for producing electromagnetic silicon steel having a cube-on-edge orientation and a permeability of at least 1850 ($G/O_e$) at 10 oersteds, which process includes the steps of: preparing a melt of silicon steel consisting essentially of, by weight, up to 0.07% carbon, from 2.6 to 4.0% silicon, from 0.03 to 0.24% manganese, from 0.01 to 0.09% of material selected from the group consisting of sulfur and selenium, from 0.0006 to 0.0035% boron, up to 0.02% nitrogen, up to 0.5% copper, balance iron; casting said steel; hot rolling said steel into a hot rolled band; cold rolling said steel, decarburizing said steel; and final texture annealing said steel; the improvement comprising the steps of coating the surface of said steel with a base coating consisting essentially of:

(a) 100 parts, by weight, of at least one substance selected from the group consisting of boron, boron compounds, sulfur, sulfur compounds, selenium, selenium compounds, and oxides and hydroxides of magnesium, calcium, aluminum, titanium and manganese; and (b) 0.5 to 50 parts, by weight of at least one nitrogen-bearing compound selected from the group consisting of $(NH_4)_2SO_4$, $Fe(NO_3)_3$, $Al(NO_3)_3$, $Mg(NO_3)_2$ and $Zn(NO_3)_2$;

and final texture annealing said steel; said steel's texture and magnetic properties being, in part, attributable to said nitrogen bearing compound.

9. The process according to claim 8, wherein said melt has at least 0.0008% boron.

10. The improvement according to claim 9, wherein said coating has from 1.5 to 5 parts, by weight, of at least one nitrogen-bearing compound.

11. The improvement according to claim 9, wherein said coating contains $(NH_4)_2SO_4$.

12. The improvement according to claim 9, wherein said coating consists essentially of: 100 parts, by weight, of boron, boron compounds, and oxides and hydroxides of magnesium; and 0.5 to 50 parts, by weight, of at least one nitrogen-bearing compound selected from the group consisting of $(NH_4)_2SO_4$, $Fe(NO_3)_3$, $Al(NO_3)_3$, $Mg(NO_3)_2$ and $Zn(NO_3)_2$.

13. The improvement according to claim 12, wherein said coating has from 1.5 to 5 parts, by weight, of at least one nitrogen-bearing compound.

14. The improvement according to claim 12, wherein said coating contains $(NH_4)_2SO_4$.

15. The process according to claim 9, wherein said steel is cold rolled at a reduction of at least 80%.

* * * * *